US005251974A

United States Patent [19]

Beals

[11] Patent Number: 5,251,974

[45] **Date of Patent: * Oct. 12, 1993**

[54] MULTI-DRAWER FILE CABINET

[75] Inventor: Ralph Beals, Muscatine, Iowa

[73] Assignee: Hon Industries Inc., Muscatine, Iowa

[ * ] Notice: The portion of the term of this patent subsequent to Apr. 7, 2009 has been disclaimed.

[21] Appl. No.: 654,351

[22] Filed: Feb. 12, 1991

Related U.S. Application Data

[63] Continuation-in-part of Ser. No. 279,330, Dec. 2, 1988, Pat. No. 5,102,210, which is a continuation of Ser. No. 30,052, Mar. 24, 1987, abandoned.

[51] Int. Cl.[5] ..... A47B 88/00

[52] U.S. Cl. ..... 312/330.1

[58] Field of Search ..... 312/257.1, 263, 265.1-265.4, 312/330.1

[56] References Cited

U.S. PATENT DOCUMENTS

| | | | |
|---|---|---|---|
| 1,055,697 | 3/1913 | Beecher . | |
| 1,200,882 | 10/1916 | Schaefer . | |
| 1,238,215 | 8/1917 | Terrell . | |
| 1,282,833 | 10/1918 | Holder . | |
| 1,292,946 | 1/1919 | Yawman . | |
| 1,321,097 | 11/1919 | Gonzales . | |
| 1,340,562 | 5/1920 | Sandmann . | |
| 1,450,180 | 4/1923 | Jamison . | |
| 1,523,653 | 1/1925 | Larson et al. . | |
| 2,027,154 | 1/1936 | Derman . | |
| 2,437,665 | 3/1948 | Rose . | |
| 2,520,506 | 8/1950 | Mankki . | |
| 2,547,463 | 4/1951 | Haut . | |
| 2,727,800 | 12/1955 | Snider . | |
| 3,328,102 | 6/1967 | Stackhouse . | |
| 3,346,316 | 10/1967 | Morioka et al. . | |
| 3,399,941 | 9/1968 | Hansen et al. . | |
| 3,404,931 | 10/1968 | Fall et al. | 312/265.4 |
| 3,437,392 | 4/1969 | Hilfinger . | |
| 3,494,685 | 2/1970 | Fiterman et al. . | |
| 3,497,279 | 2/1970 | Chovanec . | |
| 3,563,627 | 2/1971 | Whipps . | |
| 3,738,726 | 6/1973 | Burst et al. . | |
| 3,835,354 | 10/1974 | Torres-Pena . | |
| 3,900,236 | 8/1975 | Goulish et al. . | |
| 3,909,090 | 9/1975 | Breckner et al. . | |
| 3,969,008 | 7/1976 | Pergler . | |

(List continued on next page.)

FOREIGN PATENT DOCUMENTS

| | | | |
|---|---|---|---|
| 1447386 | 6/1965 | France | 312/184 |

OTHER PUBLICATIONS

"To Our Shareholders", 4th Quarter Report 1987 of Hon Industries.

*Primary Examiner*—Peter R. Brown

*Attorney, Agent, or Firm*—Leydig, Voit & Mayer, Ltd.

[57] ABSTRACT

A rugged and inexpensive filing cabinet constructed from thin, prefinished metal and a method for making the same. All component parts including the case envelope, case back, kick plate, drawers, any interior webs, and drawer supports are designed to be cut from only four discrete coils of metal with waste attributable to trimming or removal of excess metal maintained at a minimum. Ruggedness and strength are maintained, despite the relative thinness of the metal, because the vertical corners and other potentially critical areas subjected to increased stress are reinforced with structural elements adhesively bonded in place. Certain structural elements also function as jigging members during the adhesive bonding of the component parts. In addition, the design of the present invention provides a versatile and adaptable end product due to the interchangeability of certain component parts. The cabinet has an integrally or separately formed web parallel to the top and located between the recesses for receiving two of the drawers. The web partitions and strengthens the cabinet particularly one having three, four, or more vertically stacked letter file drawers.

20 Claims, 8 Drawing Sheets

U.S. PATENT DOCUMENTS 4,102,554 7/1978 Reimer .
4,161,125 7/1979 Degnan .
4,232,920 11/1980 Bukaitz .
4,272,138 6/1981 Stark .
4,298,236 11/1981 Laroche .
4,355,851 10/1982 Slusser .
4,429,930 2/1984 Blouin .
4,433,788 2/1984 Erlam et al. .
4,438,994 3/1984 Davis .
4,441,767 4/1984 Stark .
4,447,098 5/1984 Parker .
4,480,883 11/1984 Young .
4,500,146 2/1985 Peterson .
4,541,675 9/1985 Everett .
4,561,706 12/1985 Grati .
4,586,348 5/1986 Nakayama et al. .
4,595,247 6/1986 Zank .
4,671,581 6/1987 Faust et al. .
5,102,210 4/1992 Beals ..... 312/330.1

FIG. 3A
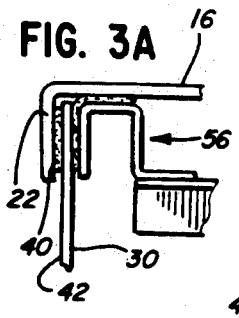
FIG. 3
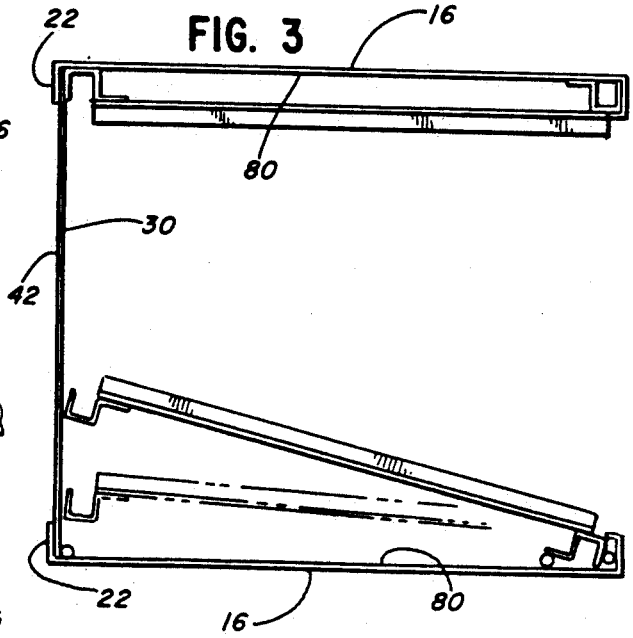
FIG. 3B
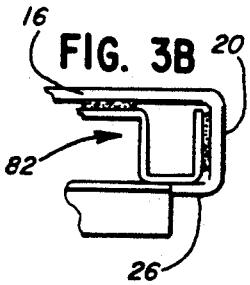
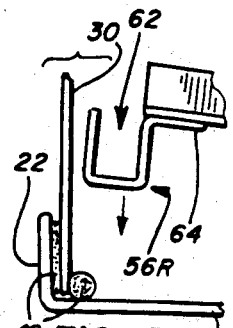
FIG. 3C
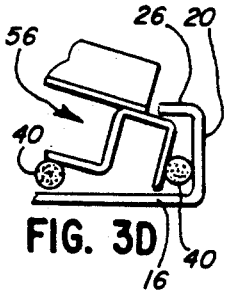
FIG. 3D
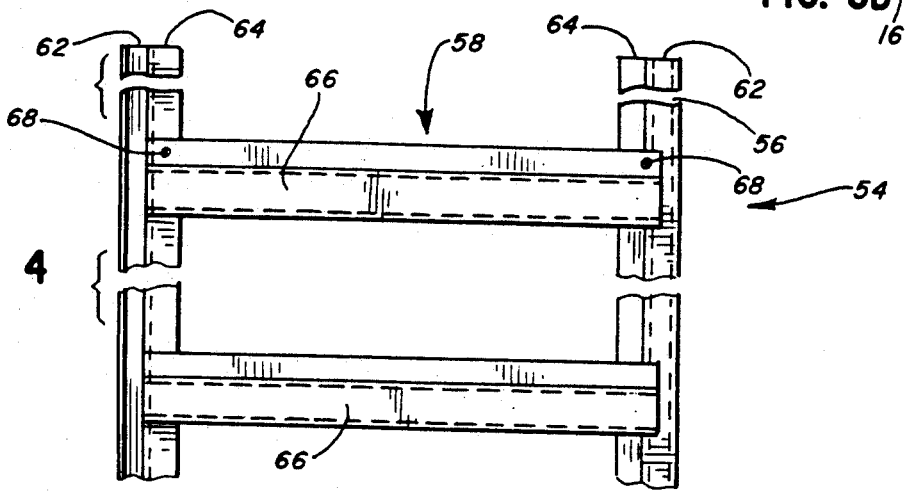
FIG. 4
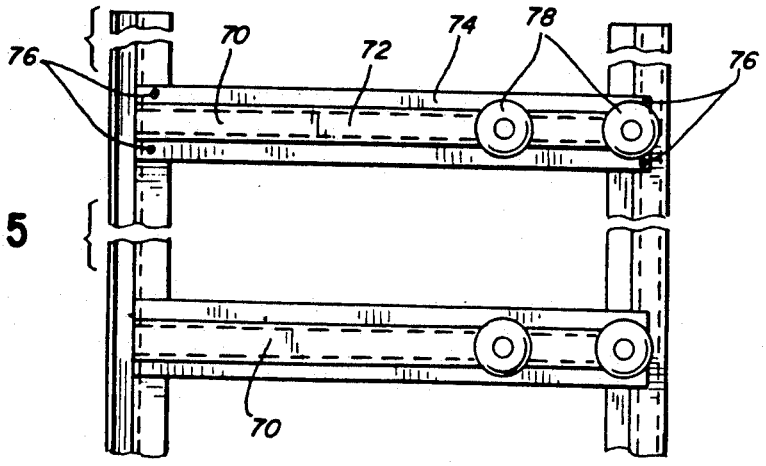
FIG. 5

FIG. 6
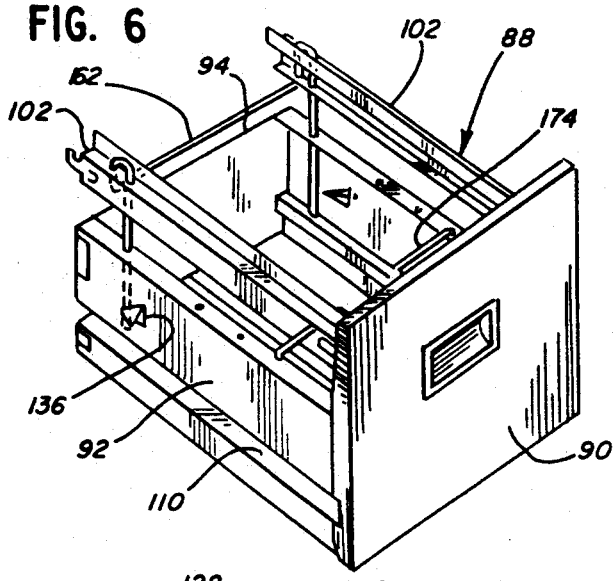
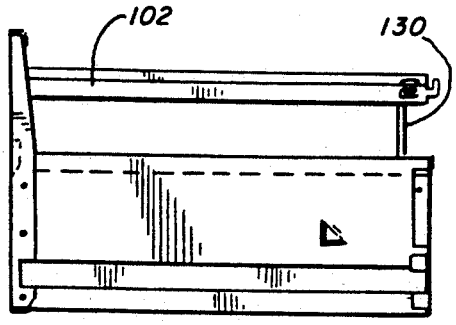
FIG. 7
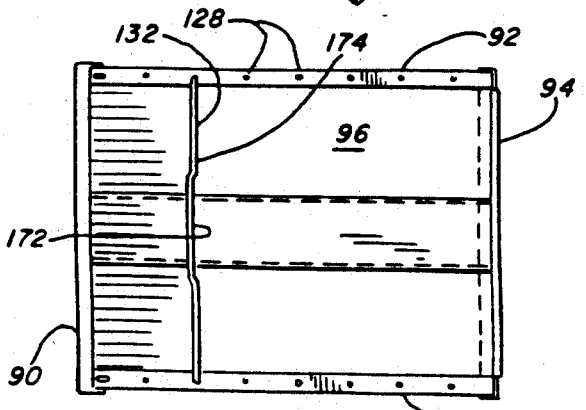
FIG. 9
FIG. 8A
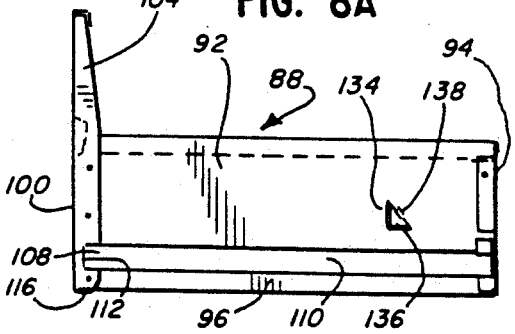
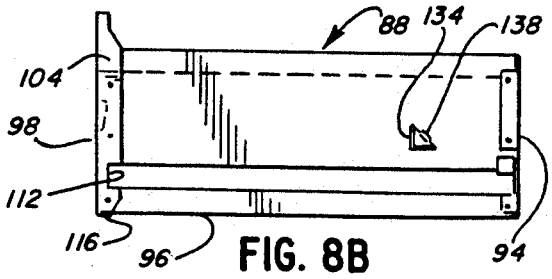
FIG. 8B
FIG. 10
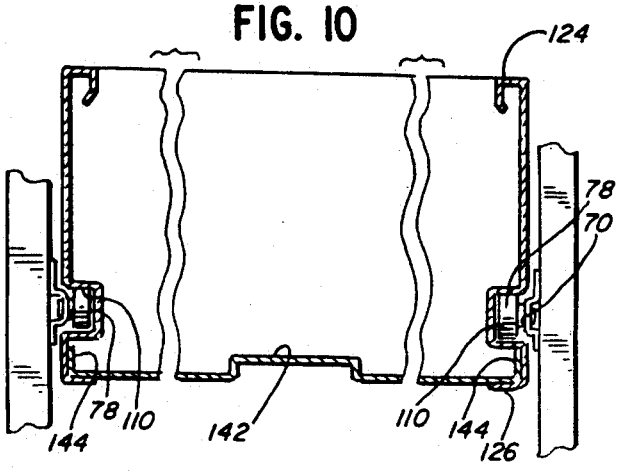
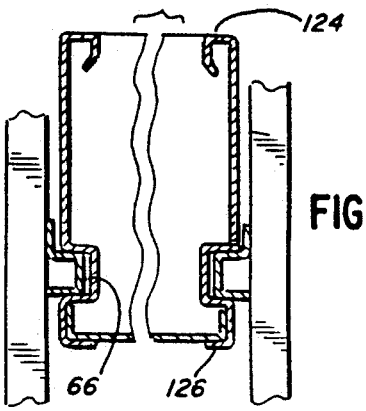
FIG. 11

FIG. 12
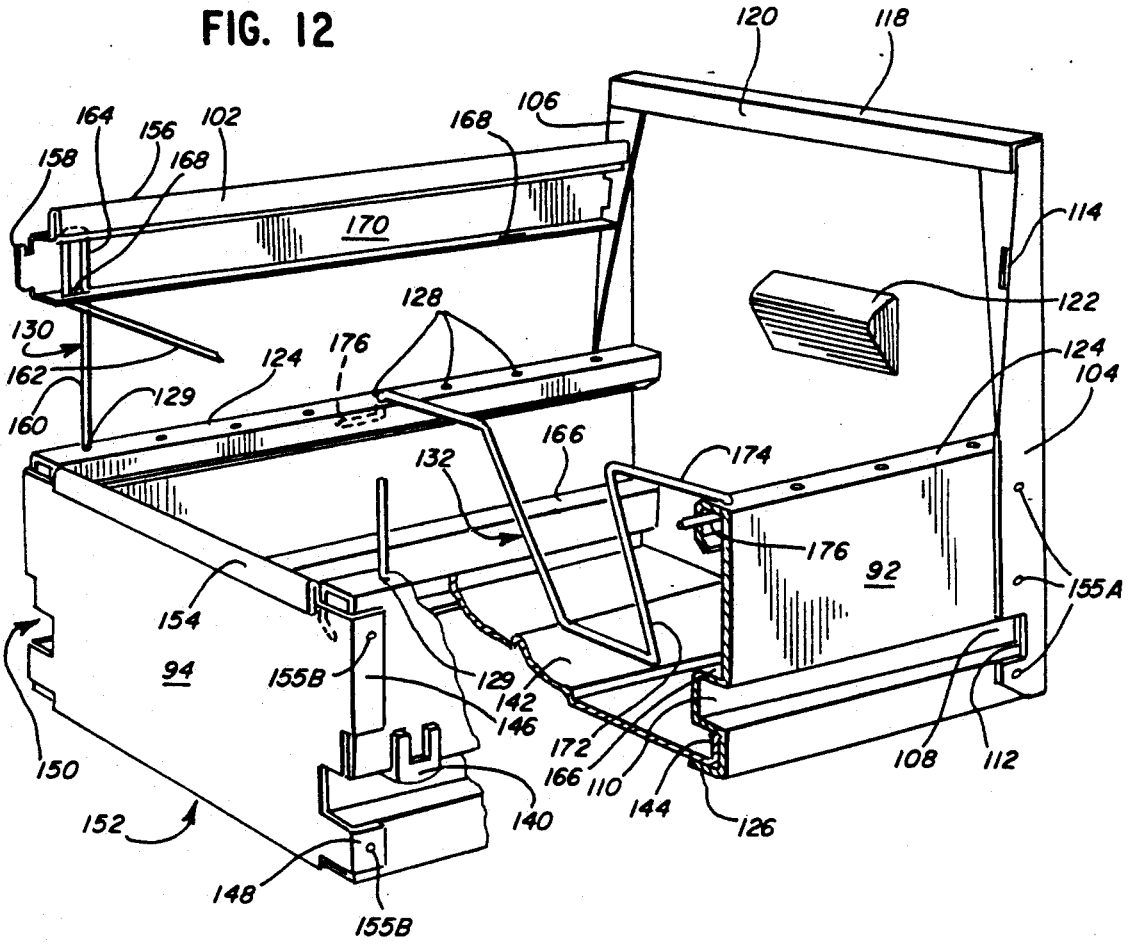
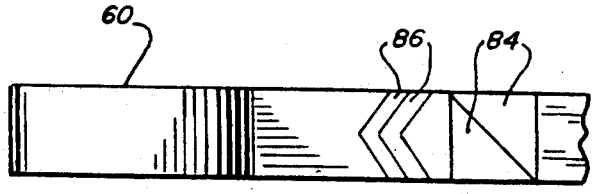
FIG. 13
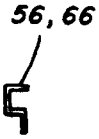
FIG.13A
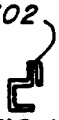
FIG.13B

FIG. 14
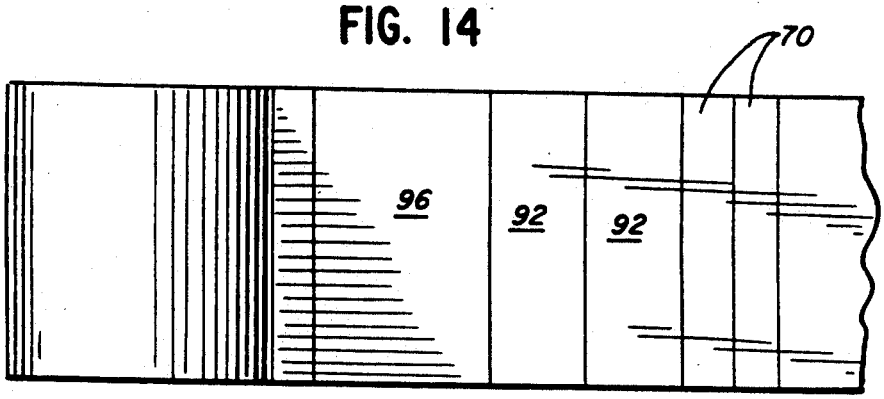
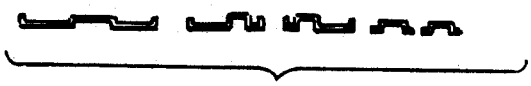
FIG. 14A
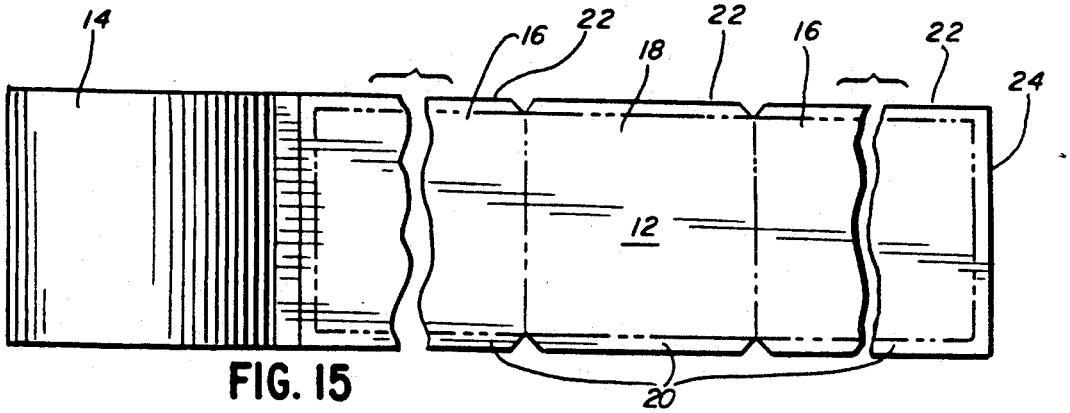
FIG. 15
FIG. 16
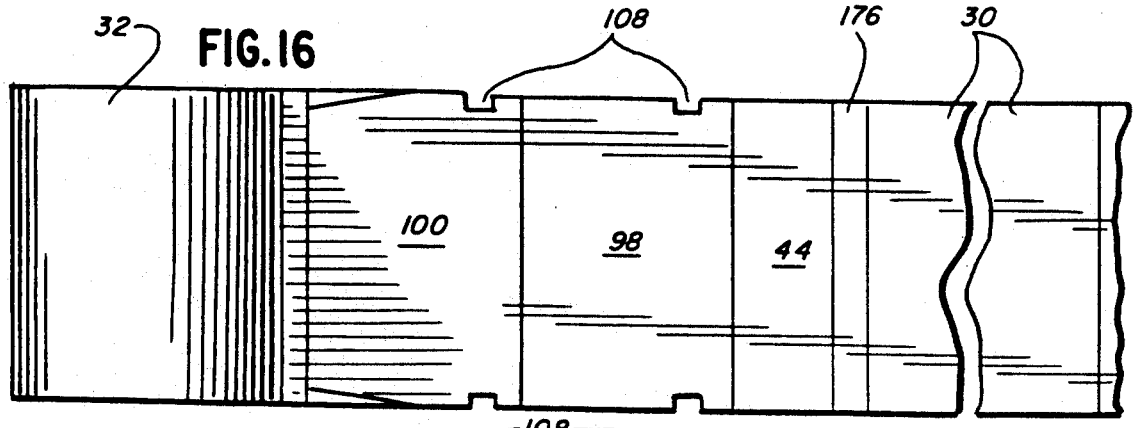
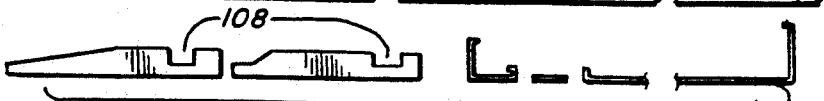
FIG. 16A FIG. 18
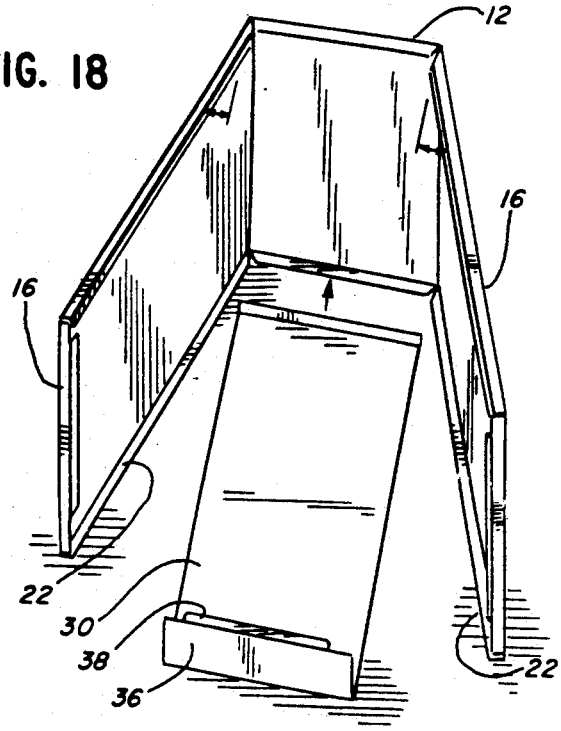
FIG. 19
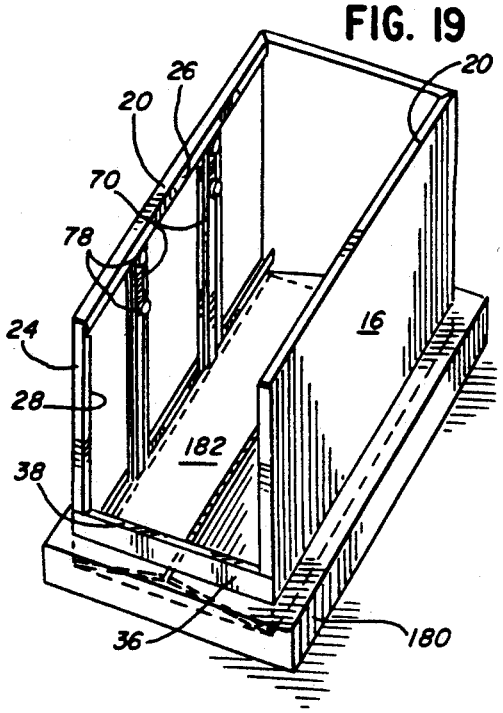
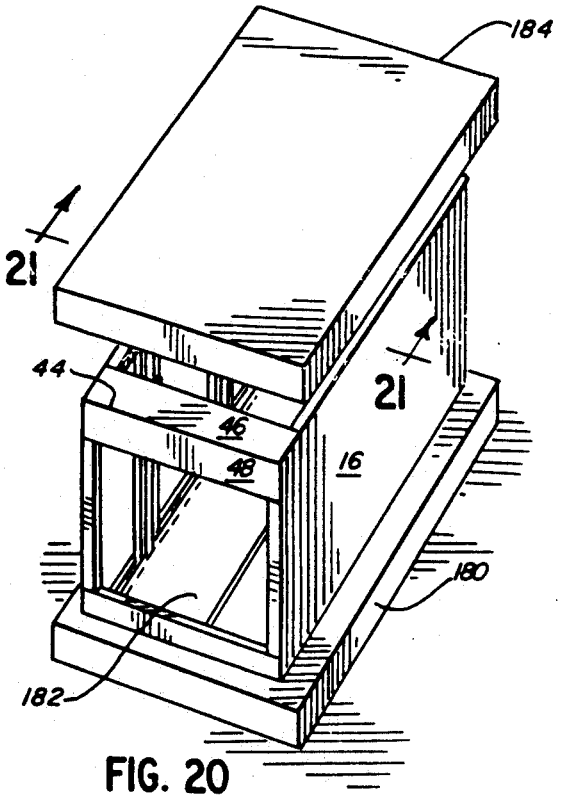
FIG. 20
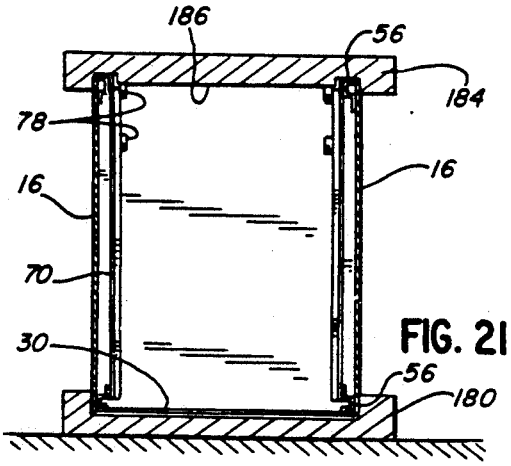
FIG. 21
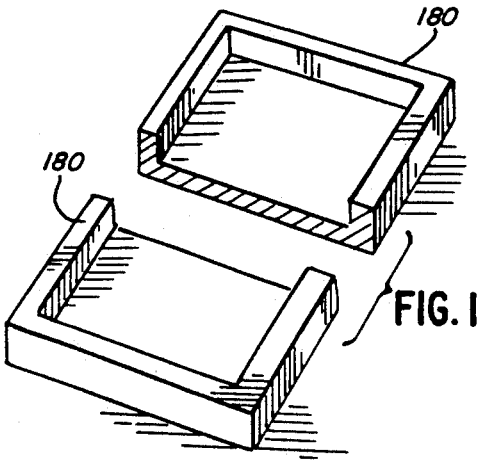
FIG. 17

18A
16A
16
30A
30
230
20
26
84A
86A
234
248
256
238
258
236
228
246
254
240
232
242
244
252
56
58
212
210
208
206
38
36
50
44
46
48

MULTI-DRAWER FILE CABINET

CROSS-REFERENCE TO RELATED APPLICATIONS

This application is a continuation-in-part of U.S. Ser. No. 07/279,330, filed Dec. 2, 1988 by the same inventor, issued as U.S. Pat. No. 5,102,210 on Apr. 7, 1992, which in turn is a continuation of U.S. Ser. No. 07/030,052, filed Mar. 24, 1987 by the same inventor, now abandoned.

FIELD OF THE INVENTION

This invention relates to metal filing cabinets and to methods for constructing such cabinets. More particularly, this invention relates to forming very low-cost but sturdy filing cabinets by using prefinished light gauge steel, joining the elements of the cabinet together using an adhesive, and preferably by using designs and techniques which minimize the variety of steel stock widths that are required while also minimizing the scrap or waste.

BACKGROUND OF THE INVENTION

Originally, metal filing cabinet case envelopes or shells were made from separate side, top, back and bottom walls welded or otherwise fastened together and then painted on the outside. Drawers were made in much the same manner with the separate bottom, sides and end walls welded or otherwise fastened together.

While many filing cabinets are still constructed this way today, alternate methods of assembly have arisen which have allowed manufacturers to construct file cabinets from pre-painted or prefinished steel. Because the finish on pre-painted steel is ruined if welded, requiring the metal to be repainted, it is highly desirable to avoid welding as the method for assembling the component pieces into a final filing cabinet. One proposed alternative cabinet design employs extruded corner posts with long narrow slots which slidably engage separate, pre-painted, rectangular shaped side and end pieces, thereby avoiding welding or even riveting the pieces together. Other proposed designs for cabinets or similar structures rely upon folding various portions of a single piece of pre-painted metal together and either interlock the portions or use mechanical fasteners. Such designs, however, would not achieve the low cost, light weight, simplicity and high strength provided by the present invention.

Appliance housings have been formed from prefinished or pre-painted metal by appliance manufacturers for some time. For example, refrigerators have been formed in this manner. However, refrigerator housings are typically made of heavy gauge steel and normally have an inner or second shell. This construction provides ample strength to the exterior housing structure.

Adhesively bonding or gluing cabinet case envelopes together is used for cardboard or wood boxes. However, cardboard boxes have neither the structural strength nor the exterior appearance found in a metal cabinet. In the case of wood boxes, strength is certainly available but limitations as to exterior appearance and weight become significant factors. Adhesively bonding cabinets of any material raises a manufacturing problem of holding or restraining the cabinet while the adhesive sets. This adds both time and expense to the manufacture of the product by requiring special clamps or vises as well as the labor necessary to install and remove these clamps or vises.

The prior art discloses that a rectangular shelf, divider, or other generally horizontal web can be mounted in a sheet metal cabinet by folding two or more of its four edges down into flanges, butting the faces of the flanges against the side and back panels of the cabinet and joining the flanges and panels.

Cabinets having a vertical stack of drawers, at least two of which are partitioned by a horizontal web within the cabinet, are also known. The partition prevents one from obtaining access to a drawer by removing other drawers from the cabinet, as when some drawers are for storing documents in general use and other drawers are for securing more valuable or sensitive documents.

Sectional cabinets, each encasing one drawer, are also known. Several of these can be stacked to form a complete multi-drawer filing cabinet. Provisions can be made to join a stack of sectional cabinets, preventing them from coming apart while in use.

The use of one or more straps spanning the width of a file cabinet (generally between two drawers of a vertical stack) and directly or indirectly joined to each side wall is known. The straps strengthen the cabinet, preventing its sides from bowing out when the drawers are heavily weighted or the cabinet is otherwise stressed during shipping or use. The straps have particularly been employed near the front of the cabinet, as the back panel of the cabinet typically prevents the side panels from bowing at the rear of the cabinet.

OBJECTS OF THE INVENTION

It is a general object of this invention to provide an improved, lightweight, economical filing cabinet having improved structural strength.

It is another object of this invention to provide an improved method of constructing low cost filing cabinets by constructing the component elements from a limited inventory of prefinished metal blanks.

It is still another object of this invention to provide a versatile cabinet in which many of the component pieces are interchangeable.

It is another object of this invention to provide a cabinet which is assembled by adhesively bonding component parts which are partially self clamping.

An additional object of the invention is to form a filing cabinet having acceptable strength from very light gauge steel.

A further object of the invention is to provide an improved tall, multi-drawer filing cabinet which also attains the aforementioned objects.

Other objects and advantages will become apparent upon reading the following detailed description and appended claims, and upon reference to the accompanying drawings.

SUMMARY OF THE INVENTION

The cabinet according to the present invention includes recesses for receiving at least two drawers and at least one reinforcing web disposed within the cabinet, oriented generally horizontally, and preferably joined to the side panels of the cabinet between two adjacent drawer recesses. The reinforcing web is preferably located between the second and third drawers in a four-drawer construction. The edges of the reinforcing web can have integral, folded edge portions joined to the side panels of the cabinet by an adhesive. Each side panel of the cabinet can be divided into an upper portion above the reinforcing web and a lower portion below the reinforcing web.

In one embodiment of the invention, the upper and lower portions of each side panel are formed from separate pieces. At least some of the integral, folded edge portions of the reinforcing web can define the lower portions of at least some of the side panels, while the upper portions of the side panels can be folded from the sheet forming the top of the cabinet.

In a preferred embodiment of the invention, the upper and lower portions of each side panel are formed from one piece and the reinforcing web is a separate piece spanning between and adhered to the side panels. In both embodiments, the reinforcing web stiffens the multi-drawer cabinet considerably.

Despite the use of light gauge steel, e.g., having a thickness of 0.0195 inches (about 0.5 mm.) or less, the cabinet case is rigid and strong. Furthermore, as a result of using light gauge metal, the cabinet of the present invention may be 20 to 30 percent lighter in weight and steel usage than conventional cabinets.

The use of pre-painted or other prefinished metal readily permits a virtually unlimited color selection as well as simulated wood grain and other patterns at a cost significantly less than the cost of creating these same finishes on cabinets which are assembled prior to finishing. This fact, in combination with the use of light gauge metal, allows the cabinet to be constructed at a cost significantly below that of present techniques while improving structural strength and marketing flexibility.

More particularly, and with respect to the preferred embodiment, each component part of a file cabinet may be stamped from one of only four discrete widths of pre-painted sheet metal. These flat blanks are folded as necessary to form the component parts and are assembled into the cabinet structure.

The case is assembled by a combination of adhesively bonding and mechanically fastening the component pieces together. The components of the drawers also may be assembled by adhesive bonding or may be secured by mechanical fastening techniques. In comparison to welding or any other method of mechanically fastening metal, adhesive bonding is superior in most instances because it can provide complete or 100 percent attachment between the joined metal surfaces. This, in effect, creates a single part from multiple pieces whereas mechanical fastening or welding between separate pieces of metal only provides small areas of attachment at the sites of the attachments or welds. The components are still separate everywhere else along their interface. Consequently, the present design and method of construction allows lightweight and thin gauge metal to be used and insures a lightweight cabinet of superior strength and rigidity.

The present invention is specifically designed to eliminate a large portion of the assembly problems associated with adhesively bonding metal. To this end, the preferred embodiment employs interfitting components which are wedge fit together and therefore act as self restraining clamps to hold the assembled pieces in position while the adhesive sets to bond the components to one another. The design of the vertical channels allows them to cooperate with the interior corners of the cabinet envelope so that the track assemblies can be wedged into the cabinet to hold the various edges of the envelope side, top and back walls in place while the adhesive bond is set. As a result, an integral component of the cabinet takes the place of a special clamp and does not need to be removed after the adhesive bonding has set, thereby saving significant production costs.

In addition to providing this self clamping function, the vertical corner channels provide the cabinet with structural rigidity, ruggedness or impact resistance and strength. This allows the cabinet pieces to be manufactured from thin gauge metal. While the prior art discloses internal posts and corner supports for providing both strength and structural framing to cabinets and other similar hollow structures, these frame members are typically mechanically fastened to the cabinet case. In the present invention, the corner channels are adhesively bonded to the interior surface of the case envelope to provide a complete surface-to-surface attachment. The result of this total bond is to create, in effect, a one piece structure of superior strength and ruggedness in comparison to a structure formed by mechanically fastening multiple pieces together.

Still another factor in reducing the inventory required to assemble these cabinets and, consequently, a factor in reducing the cost of the overall cabinet is that many of the component parts are reversibly or symmetrically designed in order that one part can be utilized in more than one place. For example, the vertical corner channels are identical multi-sided members which, as a result of the particular cross sectional shape, can be placed in each of the four corners of the cabinet simply by rotating the relative position of the vertical channel. As a result, only one type of corner channel rather than two or four distinct types is required. Moreover, this same vertical channel, when cut to an appropriate length, functions as a horizontal slide track. Consequently, the versatility of the design allows one manufactured shape to be used for at least two separate pieces.

The versatility of the structure is further evidenced by the design of a second drawer track, in this case a roller track, that is interchangeable with the slide track. Both of these drawer tracks, roller or slide, are designed so that each drawer track can function on either the right or left side of the cabinet. As a result, separate right and left side pieces do not need to be constructed.

The versatility of the present design is still further shown in the drawer construction. The design employs a single drawer base unit which accommodates two different drawer fronts. One drawer front, a "box drawer" front, is slightly taller than the base drawer unit and the other drawer front, or "letter drawer" front, is almost twice as tall as the box front and creates a drawer for much larger articles but employs the same drawer base unit. In addition, drawer extensions or holder rails have been designed as an accessory to attach to the base unit and the letter drawer front to create a drawer for hanging files. These holder rails are manufactured from the same width of pre-painted steel as the vertical channels but, in the spirit of the present invention, are reversible and symmetrical in the same manner as the drawer tracks so that any one extension can fit on either the right or left side of the drawer base unit.

These features combine to create an inexpensive, lightweight filing cabinet of superior strength.

BRIEF DESCRIPTION OF DRAWINGS

FIG. 3 is a horizontal, sectional view of a filing cabinet of the present invention further showing insertion of a track assembly.

FIGS. 3A and 3B are enlarged partial top views of the vertical channels adhesively bonded to the interior corners of the case envelope.

FIGS. 3C and 3D are enlarged partial top views of the vertical channels being positioned in the case envelope.

FIG. 4 is a side view of a track assembly employing slide drawer tracks.

FIG. 5 is a side view of a track assembly employing roller track drawer tracks.

FIG. 6 is a perspective top view of a letter drawer further including holder rail accessories.

FIG. 7 is a side view of the letter drawer of FIG. 6.

FIG. 8A is a side view of the base drawer unit with a letter drawer front.

FIG. 8B is a side view of the base drawer unit with a box drawer front.

FIG. 9 is a top view of the letter drawer unit.

FIG. 10 is a broken cross sectional view of the base drawer unit of the present invention showing engagement with a roller track assembly.

FIG. 11 is a broken cross sectional view of the base drawer unit of the present invention showing engagement with a slide track assembly.

FIG. 12 is a rear elevated perspective view of the letter drawer shown in FIGS. 6, 7, partially broken away.

FIG. 13 is a top view of a prefinished sheet steel blank strip of indeterminate length supplied in coil form and used to make the vertical channel, slide track members and holder rails.

FIG. 13A is a schematic end view of the vertical channel or slide track produced from the prefinished steel strip shown in FIG. 13.

FIG. 13B is a schematic end view of the holder rail produced from the prefinished strip shown in FIG. 13.

FIG. 14 is a top view of another prefinished sheet steel blank strip of indeterminate length supplied in coil form used to make the drawer bottom, drawer left and right sides and roller track members.

FIG. 14A is a schematic end view of the drawer bottom, drawer left and right sides and roller track member produced from the prefinished steel strip shown in FIG. 14.

FIG. 15 is a top view of another prefinished sheet steel blank strip of indeterminate length supplied in coil form used to make the case envelope with certain cut and fold lines illustrated on the blank strip.

FIG. 16 is a top view of another prefinished steel blank strip of indeterminate length supplied in coil form used to make the letter and box drawer fronts, drawer back, kick plate, strap and case back with certain cut and fold lines illustrated on the blank strip.

FIG. 16A is an end view of the drawer fronts, drawer back, kick plate, strap and case back made from the prefinished steel strip shown in FIG. 16.

FIG. 17 is an elevated perspective view of the first squaring member of the present invention.

FIG. 18 is an elevated perspective view of the case envelope and case back prior to assembly.

FIG. 19 is an elevated perspective view showing the case envelope, case back and track assemblies positioned in the first squaring member during assembly.

FIG. 20 is an elevated perspective view of the cabinet shown on FIG. 19 after the kick plate has been positioned for assembly and prior to placing the second squaring means on the cabinet.

FIG. 21 is a cross sectional view of the cabinet shown in FIG. 20 after the second squaring member has been placed on the cabinet.

DETAILED DESCRIPTION OF THE INVENTION

The relationship and use of the various features of this invention will be better understood by the following detailed description. However, the embodiments of the invention described below are by way of example only and applicant does not limit himself to these embodiments. Furthermore, one should understand that the drawings are not to scale and that the embodiments are illustrated in part by graphic symbols and fragmentary views. In certain instances, details may have been omitted which are not necessary for an understanding of the present invention.

Figures 1, 2:
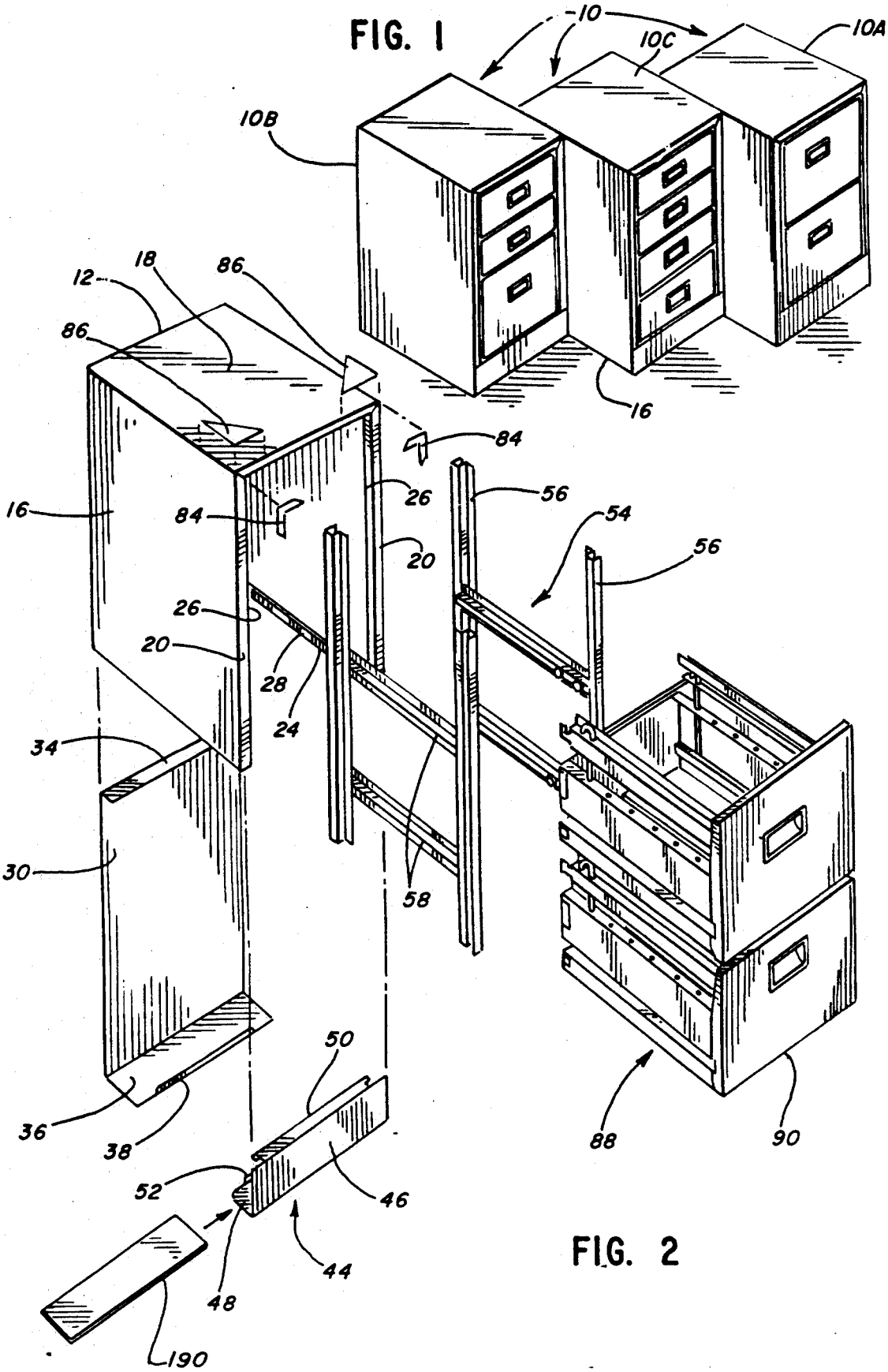
FIG. 1 is a perspective view of three filing cabinets employing teachings of the present invention.
FIG. 2 is an exploded perspective view of the two-drawer filing cabinet of FIG. 1.

A filing cabinet 10 of the present invention, shown in various final forms in FIG. 1, is constructed from only four discrete widths of sheet metal blanks. Each of these blanks is of a width to form the respective component(s) without edge trimming and attendant scrap or waste, and is of indeterminate length, preferably being supplied and inventoried in coil form. The sheet metal is pre-painted on both sides and the element or component pieces are stamped out from these four coils of sheet metal. FIGS. 13-16 show the four rolls of metal strip blanks and the silhouettes of the respective component parts that are cut from each roll. FIGS. 13A-16A show the profiles of the component parts. After being cut from the continuous rolls, these pieces of sheet metal or blanks are folded into the various component parts which make up the filing cabinet and are assembled into the final product.

The present invention provides sufficient versatility to create at least three basic styles of cabinets (as illustrated in FIG. 1) from one standard cabinet envelope. As seen in FIG. 1, the final product can be a two (10A), three (10B) or four (10C) drawer unit. Of course, it is recognized that case envelopes of different sizes can be manufactured in accordance with the present invention to provide either one drawer cabinets or cabinets of more than four drawers. Similarly, separate cabinets could be combined or stacked to form larger cabinets.

It can be seen from FIGS. 13-16 that all the components originate from one of only four widths of prepainted metal. Specifically, the case envelope is cut from one roll of metal, FIG. 15. The drawer bottom, both drawer sides and the roller track members are cut from a second roll of metal, FIG. 14. The drawer front and back, the kick plate and optional strap and the case back (which is sometimes also referred to herein as a "side") are cut from a third width, FIG. 16; and the vertical channels, the slide track members, and the strengthening chevrons, corner plates and holder rails are cut from the fourth roll of metal, FIG. 13.

Turning now to the particular component parts of a cabinet 10, the case envelope 12 starts out as a flat piece of pre-painted steel as shown in FIG. 15. The individual case envelope blank is cut from the coil 14 and folded into a three-sided shape having two side walls 16 and a top 18 (FIG. 2). As can be seen from FIG. 15, the depth of the cabinet is contingent upon the width of the coil of metal from which it is formed. Consequently, by using varying widths of metal, cabinets can be manufactured in conventional depths between 14 and 25 inches. The perimeter edges of the case envelope or shell are folded inwardly to provide a front wall portion or a front perimeter flange 20, a rear perimeter flange 22 and a base flange 24 at the bottom edge of each side wall 16. The front wall portion or perimeter flange 20 and the base flanges 24 are folded a second time to form return flanges 26 and 28 respectively. All of these flanges provide structural rigidity to the case envelope and further assist in the assembly of the cabinet.

The case back 30, FIGS. 2 and 16, is cut from a blank of prefinished or pre-painted steel from a coil 32 of a different width than the case envelope 12. It has a top flange 34 and a bottom flange 36 which provide case rigidity when bonded and fastened to the case envelope and which assists in placing or locating the case back to be adhesively bonded to the case envelope 12 in the proper relative position. The bottom flange 36 is provided with a small return flange 38. The return flange is narrower than the case back by the requisite amount to accommodate the base flanges 24 of the case envelope side walls 16 when the two pieces are bonded together. The return flange 38 functions to accurately and squarely align the side walls and the case back by providing a stop or locater for the base flanges of the side walls.

Before the case back is put in place with the envelope 12, a bead of glue or adhesive 40 is placed along each of the surfaces which will be in contact. In joining these two pieces, the adhesive 40 will be placed on the inside surface of the rear perimeter flange 22 and on the upper lateral edges of the bottom flange 36 of the case back 30 as well as the upper surface of the case back top flange 34. The case back is then positioned inside the case envelope so that the exterior surface 42 abuts the rear perimeter flange 22 of the case envelope, the upper surface of the top flange 34 contacts the inside surface of the case envelope top 18 and the bottom flange 36 underlies and contacts the base flanges 24 of the case envelope side walls 16. Once the bond is set, the case back 30 will be strongly bonded to the case envelope 12. As a result of this 100 percent surface-to-surface bond, the case back 30 will act to inhibit side sway in the cabinet. In addition, to add further strength and rigidity to the case structure, the case back bottom flange 36 and the base flanges 24 of the case envelope side walls 16 can be mechanically fastened in addition to being adhesively bonded.

The cabinet kick plate 44, FIG. 16, is formed from the same roll of prefinished sheet metal 32 as the case back 30 and encloses the lower front corner of the case envelope 12. The kick plate 44 is provided with a front or upper portion 46 and a lower portion 48 wherein the upper portion 46 extends across the front opening of the case envelope and the lower portion 48 extends across the bottom opening of the case envelope. The upper portion 46 is further provided with an inwardly directed flange 50 notched to accommodate the front perimeter flanges 20 and return flange 26 of the case envelope, and serve as a stop or locator for the lower front portion of the envelope during assembly. The bottom portion of the kick plate 44 has an upturned flange 52 which functions similarly to the return flange 38 formed on the bottom flange 36 of the case back 30; which also assists in squarely aligning the case envelope. After bonding the track assemblies 54 to the case envelope 12, the kick plate 44 is adhesively bonded to the case envelope 12 along the contacting surfaces of the front perimeter flange 20 and upper portion 46 and the base flanges 24 of the side walls 16 and the lower portion 48. The lower portion 48 also may be mechanically fastened to the base flange 24 of the case side walls 16 to provide further structural rigidity to the case 10.

Turning now to the track assembly 54, it can be seen from FIG. 2 that each track assembly 54 is constructed from two vertical channels or corner posts 56 interconnected by two drawer tracks 58. The vertical channels 56 are multi-sided structural and reinforcing members which provide strength to the overall cabinet 10, and the drawer tracks 58 provide sliding support engagement for the drawers. Each vertical channel is roll formed from a third discrete width of pre-painted sheet metal 60 as shown in FIG. 13. The vertical channel is a four sided structural member with three of the sides forming an open sided channel 62 and the fourth side forming a support flange 64 extending outwardly from the channel. Thus, surfaces are provided at right angles to one another to support the side walls of the case on both sides of each corner while providing an appropriate flat surface for attachment of the tracks; see FIG. 3 and FIGS. 3A–D. The strength and impact resistance (ruggedness) provided by the vertical channels 56 allow the filing cabinet to be constructed from metal as thin as 0.195 inches and even thinner if desired. Moreover, the vertical channels 56 reduce or remove the need for using elaborate and expensive shipping materials to protect the final product during handling and shipping for distribution. All that is necessary is a cardboard enclosure to protect the exterior finish. This provides another cost advantage.

The present invention provides two types of drawer tracks 58. One type, slide tracks 66, are shown in FIGS. 4 and 11. The slide tracks are the same cross-sectional sizes and configuration as the vertical channel 56 but cut to a shorter length. In the context of a slide track 66, the outwardly extending flange 64 is mechanically fastened at 68 to the vertical channel 56 as shown in FIG. 4. In comparison, the second type of track 58, the roller track 70 (FIG. 5), has a raised center portion 72 with two outwardly extending support flanges 74 which abut the vertical channel 56 (see also FIG. 10) and is formed from a different coil of metal than the slide track. The roller track is affixed to the vertical channels at four locations by mechanical attachments at 76 and thereby provides greater strength for supporting heavier loads. In addition, the roller track 70 employs two rollers 78 riveted to the raised center 72 for engaging the drawer base unit. (FIG. 5).

As shown in FIG. 3, a separate track assembly 54 is placed along each side wall interior surface 80 of the case envelope 12 with a vertical channel disposed in each corner of the case envelope. The four corners of the cabinet are shown in FIGS. 3A–D. The manner in which the track assembly 54 is attached provides a self clamping action for both the envelope-back joints and for the track assembly-envelope joints, which avoids the necessity of employing special clamps or vises as well as the labor necessary to remove such devices after the adhesive bonds have set. After the case back 30 has been positioned, FIG. 3, an additional bead of glue or adhesive 40 is placed in each rear corner of the case envelope 12, FIG. 3C. In addition, two beads of adhesive 40 are placed on each front corner vertical channel 56F, FIG. 3D. The track assembly 54 is then wedged into the case envelope 12 by first placing the forward vertical channel 56F in the recess 82 formed by the front wall portion or perimeter flange 20 and return flange 26 of the case envelope (FIGS. 3, 3D) and then rotating the track assembly 54 until the rear vertical channel 56R is wedged into the back corner of the case envelope thereby spreading the adhesive 40 and bonding the vertical channel 56 to the case back 30 and case side wall interior surface 80, (FIG. 3). In this manner the track assembly 54 also acts to press the case back onto the rear perimeter flange 22 of the case envelope 12 and holds these pieces together, without employing any external jigging, while the adhesive bonds the metal edges together. Thereby the front and rear flanges of the envelope serve as the clamps or straps for the entire assembly.

Notwithstanding the use of thin gauge metal, the design of the present invention achieves strength equivalent or superior to cabinets made from heavier gauge metal. At the rear corner of the case envelope (FIG. 3A), the combination of the case back 30, rear perimeter flange 22 and vertical channel 56 adhesively bonded together provide a cabinet corner structure that is three times thicker along the back wall than the individual sheet metal used to construct the cabinet and, along the side wall, twice as thick as the individual sheet metal pieces. (FIG. 3A). As can be seen in FIG. 3B, the combination of the vertical channel 56 with the front perimeter flange 20 return flange 26 creates a four sided corner tube or frame 82. As a result of these design features, even though the cabinet is constructed of thin gauge metal, critical strength is provided to the structural areas where extra strength and impact resistance are most necessary.

Strength and structural rigidity are also enhanced by the use of corner chevrons 84 and corner plates 86. The corner chevrons 84 are adhesively bonded to the front perimeter flange 20 prior to bonding the front vertical corner channels 56 to the case envelope. These stiffening elements further act to prevent side sway of the cabinet. Additionally, the corner plates 86, shown in FIG. 2, are bonded to the inside corners of the envelope top. These plates 86 prevent corner wrinkles or cracks which might otherwise occur during the stress of shipping or transit of the cabinet or if the cabinet is dropped. The invention further contemplates that these pieces could all be constructed from a single piece of metal to facilitate installation and assembly rather than as individual pieces.

The versatility of the present invention is further evidenced by the drawer construction. In particular, the drawer design incorporates a single drawer base unit 88 and two interchangeable drawer fronts 90.

The base drawer unit 88 is comprised of two side walls 92, a back 94 and a bottom 96. The interchangeable drawer fronts 90 come in two sizes; a box drawer front 98 which is slightly taller than the drawer based unit 88 and a taller letter drawer front 100 which creates a deeper drawer. A base drawer unit 88 with a letter drawer front 100 is shown in FIG. 8A and a base drawer unit 88 with a box drawer 98 front is shown in FIG. 8B. Because two sizes of drawer fronts are available, the case envelope 12 of the present invention can be constructed with either two, three or four drawers. By simply modifying the track assemblies 54, up to four drawer tracks 58 can be mounted on the vertical channels 56 in various configurations. Particularly, the same case envelope can be constructed to hold two large or letter drawers, four box drawers or two box drawers and a single letter drawer (See FIG. 1). In addition, any of these drawers can accommodate either a slide track 66 or a roller track 70, further increasing the various combinations. The letter drawer, FIG. 8A, can be further modified to accommodate standard hanging or suspended files. As shown in FIGS. 6, 7 and 12, a pair of holder rails 102 can be attached to the side walls 92 of the base unit 88 and the letter drawer front 100.

With reference to either the box or letter drawer, (FIGS. 8A, 8B) the separate drawer fronts 90 are each provided with two side flanges 104. In the case of the letter drawer front 100, the portion of the side flange 104 which extends above the drawer side wall 92 is further provided with a return flange 106, see FIG. 12, for additional rigidity and strength. Each side flange 104 is further provided with a cut out portion or notch 108 which corresponds to the drawer channel 110 in each drawer side wall 92. The vertical edge 112 of the notch acts as a drawer stop to align the face of the drawer front 90 with the front perimeter flange of the case envelope, when the drawer is closed, in a cabinet employing slide tracks 66. If the cabinet is constructed with roller tracks 70, a pad (not shown) is inserted inside the notch 108 on the inside surface of the drawer front to act as a drawer stop when shutting the drawer. Additionally, as can be seen in FIG. 12, the return flange 106 on the letter drawer front 100 is provided with a vertical slot 114 for engaging the holder rail 102 if this accessory option is selected.

As seen in FIG. 16, both drawer fronts 98, 100 may be cut from the same coil of pre-painted metal 32. After the notches 108 are removed from the side edges, the side flanges 104 are formed. Subsequently, a bottom flange 116 is formed and then, as shown in FIG. 12, the top edge of the drawer front is folded twice to create a top flange 118 and a return flange 120 to overlap the side flanges 104 and the return flanges 106. While various types of handles may be employed in the illustrated embodiment a rectangular hole is cut in every drawer front 90 to allow insertion and attachment of a handle 122.

As shown in FIGS. 10 and 12, both the left and right drawer side walls 92 are provided with a top and bottom flange 124 and 126 respectively, as well as an inwardly directed drawer channel 110. The drawer channel 110 is designed to slidably receive either the roller track 70 or the slide track 66. As seen in FIGS. 9 and 12, the top flanges 124 of the drawer sidewalls 92 are provided with a series of equidistant spaced holes 128. The hole 129 closest the rear end of each drawer side wall 92 is enlarged with respect to the remaining holes 128 and is designed for receiving, supporting and positioning an optional support 130 for the rear or inward end of the holder rails 102 in position. The holes 128 are designed to receive and position a file follower 132 which can be adjustably positioned in any of the holes 128 to accommodate accumulated files of varying depth.

As best seen in FIGS. 8A and 8B, each side wall is also provided with an L-shaped slot 134. This slot 134 defines a tab 136 which, after the drawer has been inserted into the case envelope, can be bent outwardly to act as a drawer stop to prevent the drawer from being pulled out of the case envelope. A second, smaller screwdriver slot 138 is formed along the diagonal bend line of the tab 136 to facilitate the straightening of the tab when a drawer is to be removed from the case. Additionally, the rear edge of every side wall is provided with a grouping of three apertures (not shown) for telescopic snap engagement of a drawer glide 140. The drawer glide 140 is seen in FIG. 12 and is affixed in the drawer channel 110 only when a roller track assembly is being used. Each glide 140 extends over and is closely adjacent the upper surface 73 of raised central portion 72 of the respective roller track 70 to support the inner end of the drawer thereon when the drawer is loaded and closed or partially closed. The glides thus accommodate the forces acting on the drawer due to the position of the rollers 78 at the front of the case envelope. The rollers are sized to fit closely (e.g., 0.015" clearance) within the drawer channels and thereby pairs of rollers provide cantilever support for each drawer when opened.

As best seen in FIG. 10, the drawer bottom 96 is provided with a raised central portion 142 and upstanding side flanges 144. The drawer bottom 96 is positioned on the bottom flanges 126 of the drawer side walls 92 with the side flanges 144 abutting the inside surfaces of the drawer side walls 92. The raised central portion 142 provides structural rigidity to the drawer structure.

As seen in FIG. 12, each side of the drawer back 94 is provided with an upper and lower side flange 146 and 148 respectively. These side flanges engage the outside surfaces of the drawer side wall 92. In addition, a notch 150 is cut from the drawer back 94 between each of the side flanges to provide access to the drawer channels 110 so that the drawer can be inserted into the case envelope 12 and the drawer channels 110 can engage the drawer tracks 58 of the track assemblies 54. The drawer back 94 also has a bottom flange 152 which assists in supporting the drawer bottom 96 and a top flange 154 for providing strength and rigidly to the drawer structure. The drawer back 94 is attached to the drawer side walls and drawer bottom by mechanically fastening the upper side flanges to the side walls and the lower side flanges to the drawer bottom and drawer side wall as shown in FIG. 12.

The drawers are assembled by positioning and fastening the side walls 92 to the respective drawer front 90. This fastening may be mechanical fastening of the side flanges 104 to the overlapped side walls as shown in FIG. 12 at 155A. The bottom is then slid into position on the bottom flanges 126 and the back wall panel 94 is then applied and secured, as by fasteners 155B.

Turn now to the letter drawer, seen in FIGS. 6, 7 and 12. By adding a pair of hang rails 102 the letter drawer can be adapted to accept suspended or hanging files. The holder rails 102 are symmetrically roll formed to allow any holder rail to be installed on either the right or the left side of a letter drawer. The holder rail 102 is a three-sided open channel shaped member further having an upstanding flange 156. The flange is folded over upon itself to provide structural strength to the holder rail 102. A hook or locking tab 158 is formed at each end, for engaging the slot 114 formed in the return flange 106 of the drawer front 100 to support the front of the holder rail 102. The rear of the holder rail is supported by the support 130 as shown in FIGS. 6, 7 and 12.

The support 130 preferably is a simple bent rod or wire component. It is defined by two vertical legs 160 and a horizontal cross member 162 interconnected by a pair of looped or curved portions 164. The legs 160 are inserted into the special holes 129 in the top flange 124 of the side wall 92 and rest on the top surface 166 of the drawer channel 110. The looped or curved portions 164 extend through a slot 168 formed in the channel portion 170 of the holder rail 102 so that the rear portion of the holder rail 102 rests on and is supported by its lower horizontal flange bearing on the cross member 162. The top or upstanding flange 156 provides a rail to be engaged by and support the hanging or suspended files. It will be appreciated that insertion and removal of the support and the holder rails is accomplished by simply placing the support and the rails in position, and therefore is a simple task requiring no fasteners or tools.

As seen in FIG. 12, the file follower 132 engages the holes 128 in the top flange 124 of the drawer side wall 92. The follower 132 preferably is a bent wire or rod component and has a U-shaped central portion 172 which extends downwardly into the drawer to hold the files in position. A pair of arms 174 extend outwardly from the center portion and are bent to an L-shape configuration at each distal end 176 to engage the holes 128 in the drawer side wall top flange 124. The follower can be inserted, removed and repositioned very simply by insertion and removal of the ends 176 through the respective holes 128.

FIGS. 17–21 show the basic steps involved in the assembly of the present filing cabinet. Essentially, the case envelope 12 is placed on its back or with the rear perimeter flange 22 in contact with a conveyor or similar support. A bead of adhesive is then placed on the inside surface of the rear perimeter flange 22 and, with the side walls 16 opened slightly at the bottom to facilitate assembly, the back panel 30 is positioned in the envelope 12 and the side walls 16 are closed to squarely encompass the back panel 30. A roller or similar device (not shown) is then manually applied to the edges of the back wall 30 to flatten and spread the adhesive bead between the rear perimeter flange 22 and the back wall 30. In order to ensure square alignment between the envelope and back wall, the structure is then placed in a first squaring frame 180. (FIGS. 17, 19).

Next, the track assemblies 54 are wedge-fit into the cabinet to hold the back wall 30 in place and to ultimately provide overall structural ruggedness to the cabinet. As previously described and shown in FIG. 3, the track assemblies 54 are adhesively bonded to the back wall 30 and envelope side wall 16. However, to promote the bonding of the rear vertical corner channels 56R to the envelope side walls 16, an expander 182 is temporarily placed in the cabinet to provide the necessary lateral pressure. The frame 180 provides the complementary reactive inward forces. The expander is simply two pieces of flat metal joined by a piano hinge or similar device and having a combined width slightly greater than the width of the case envelope. The front vertical corner channels 56F do not require this lateral pressure because of the manner in which the front perimeter flange 20 and return flange 26 coact to capture the front corner channels 56F (FIG. 3B).

The kick plate 44 is the last component to be permanently attached to the case envelope 12. As seen in FIG.

20, the kick plate spans the envelope side walls 16 and overlaps the front perimeter flanges 20 and the side wall base flanges 24. With adhesive applied first, the kick plate 44 is positioned on the envelope and a second squaring frame 184 is placed on the envelope (FIG. 20). As seen in FIG. 21, the second squaring frame 184 has a raised center portion 186 which allows the frame to encompass the envelope walls and prevent the walls from any undesirable movement which would cause the pieces to be assembled in an unaligned manner. In addition, while the squaring frames are primarily employed for maintaining a square alignment of component parts, the second frame 184, due to its weight, does apply a slight downward force which assists in bonding the backwall 30 to the rear perimeter flange 22 of the envelope.

With the two squaring frames 180 and 184 in place, and the kick plate 44 and back wall 30 securely positioned, the kick plate bottom portion 48 and the back wall bottom flange 36 are mechanically fastened to the side wall base flanges 24. After the adhesive has set, the completed cabinet is then removed from the frames 180 and 184 and the expander 182 is removed from inside the cabinet. Lastly, the drawers, having been previously assembled, are placed in the cabinet to complete the assembly.

In a second embodiment of the invention, a modified filing cabinet can be constructed with the intention of stacking it on top of a first filing cabinet to provide a filing cabinet of greater capacity. While the same versatility in size and number of drawers can be available in the second or upper cabinet, the kick plate would be eliminated to reduce any unnecessary space between the drawers of the two cabinets. A bottom strap 190, shown in FIG. 2, would replace the kick plate to hold the case side walls together. The case envelope, even though shorter, can be cut from the same coil of sheet metal as is the standard size cabinet. In addition, it is also contemplated that a one-drawer case envelope can be manufactured to be stacked on another one-drawer case or the standard two-drawer case envelope to create a stacked two or three-drawer cabinet, or to stand alone as a one-drawer unit.

For physical attachment, a pair of hooks or protrusions could be provided in the back of the upper or add on cabinet to engage slots formed in the back panel of the lower cabinet to lock the cabinets together. In addition, an adhesive may be applied to the bottom of the strap 190 and to the bottom surface of the bottom flange of the case back so that the upper and lower cabinets are adhesively bonded together as well.

Figure 23:
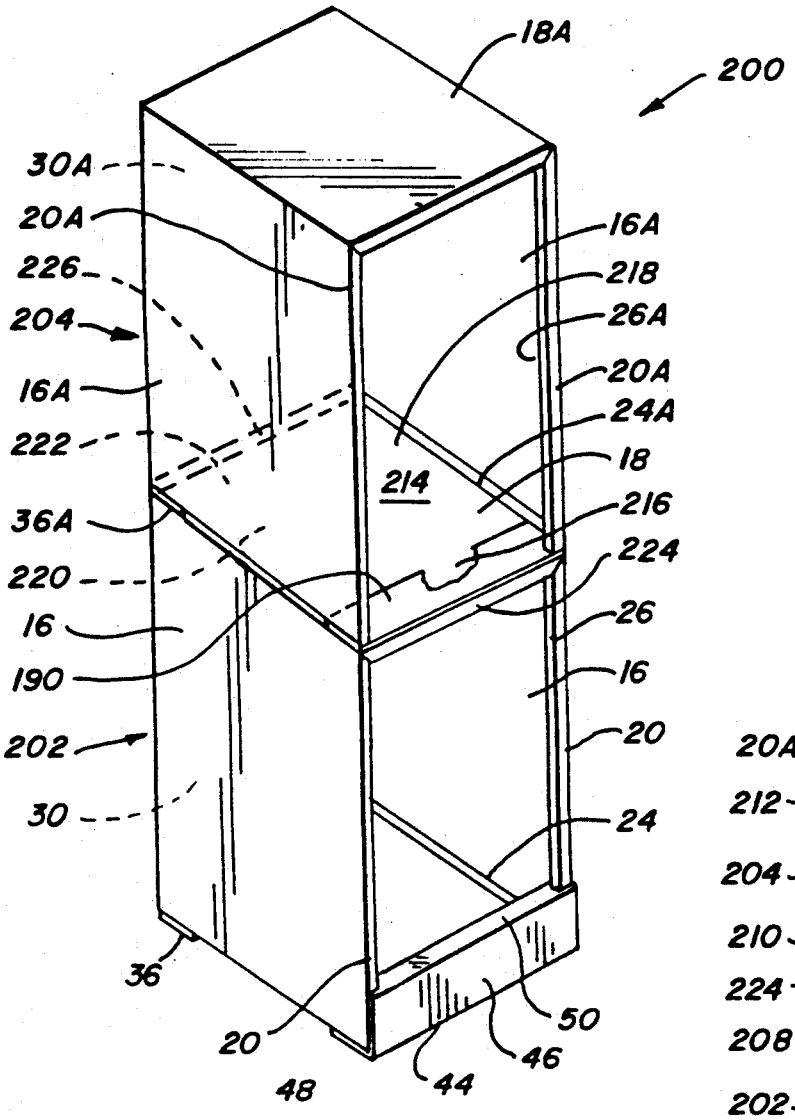
FIG. 23 is a perspective view of the embodiment of FIG. 22, with the drawers removed to reveal interior details.
Figure 22:
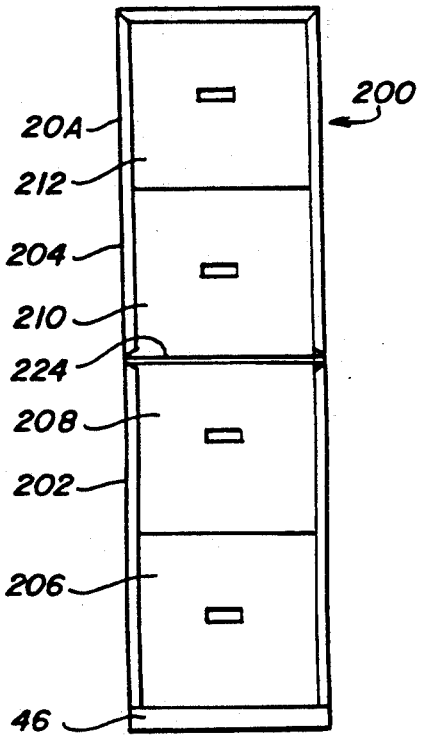
FIG. 22 is a front elevation of a second embodiment of the invention comprising two stacked and joined two-drawer letter-file cabinets.

A more specific illustration of this alternate embodiment is provided in FIGS. 22 and 23. A stacked four drawer letter file cabinet 200 comprises a lower unit 202 and an upper unit 204, permanently adhesively bonded together.

The lower unit 202 can be precisely the same as the unit 10A in FIG. 1, and is numbered with the same reference characters used in FIGS. 1-21. The upper unit 204 differs from the cabinet 10A of FIG. 1 in that the kick plate 44 is replaced by the bottom strap 190. The back plate 30A of the upper unit 204 is also shorter than the back plate 30 of the lower unit, to account for the replacement of the kick plate 44 by the vertically shorter strap 190. Apart from these changes and the additional features identified below, the parts of the upper unit 204 are identified by the same reference numbers as before, followed by the letter "A".

The top 18 of the envelope 12 of the lower unit 202 has been described above, but plays a new role in this embodiment. Here, the top 18 is an internal web which divides the interior of the cabinet 200 and the side walls 16 and back 30 into upper and lower parts. The lower part of the cabinet 200 defines recesses receiving the bottom drawer 206 and the second drawer 208, while the upper part of the cabinet 200 defines recesses receiving the third drawer 210 and the top drawer 212. The top or web 18 lies between the recesses receiving the second and third drawers 208, 210 in this embodiment.

The web 18 of FIG. 23 has a generally horizontal central portion 214 disposed parallel to the top panel 18A, a front portion 216, left and right side portions 218 and 220, and a back portion 222. As previously pointed out, the web 18 has perpendicular, integral extensions of each of the portions 216-222 which here define the lower sides 16 and the front and back flanges 224, 226 of the lower cabinet. Thus, the sides 16 are joined permanently to the web 18.

As previously mentioned, the upper and lower stacked units 204 and 202 are preferably permanently adhesively bonded together. The specific bonds in this embodiment are formed between the bottom surface of the bottom flange 36A of the back 30A of the upper unit and the upper surface of the back portion 222 of the web 18; and between the bottom surface of the bottom strap 190 of the upper unit and the upper surface of the front portion 216 of the web 18. The adhesive preferably covers the entire abutting surfaces of these respective joints. No special technique is needed to maintain the two stacked cabinets in their proper positions. The weight of the upper cabinet 204, supplemented if necessary by weights set on its top 18A, will exert an adequate clamping force. Light lateral clamping, a sleeve about the joint, a simple jig, or other expedients may be used to maintain the accuracy of alignment of the upper and lower cabinets 204 and 202 while the adhesive is setting.

The upper and lower parts of the stacked cabinet 200 need not be the same size or contain the same number and type of drawers. Each part of the cabinet 200 can contain one or more drawers. The concept of stacking cabinets particularly has application in a stacked cabinet 200 having three, four, or more drawers, however. In that construction particularly, the web 18 reinforces the cabinet 200 to prevent its sides 16 and 16A or its back 30 and 30A from bowing out. Such a stacked four-drawer unit will thus be stronger than a four-drawer letter-file cabinet constructed analogously to the cabinet 10C in FIG. 1 (but twice as tall to accommodate letter-file drawers).

More than one web 18 may be provided, to further reinforce the cabinet or for other purposes, by stacking more than two units.

Figures 24, 25:
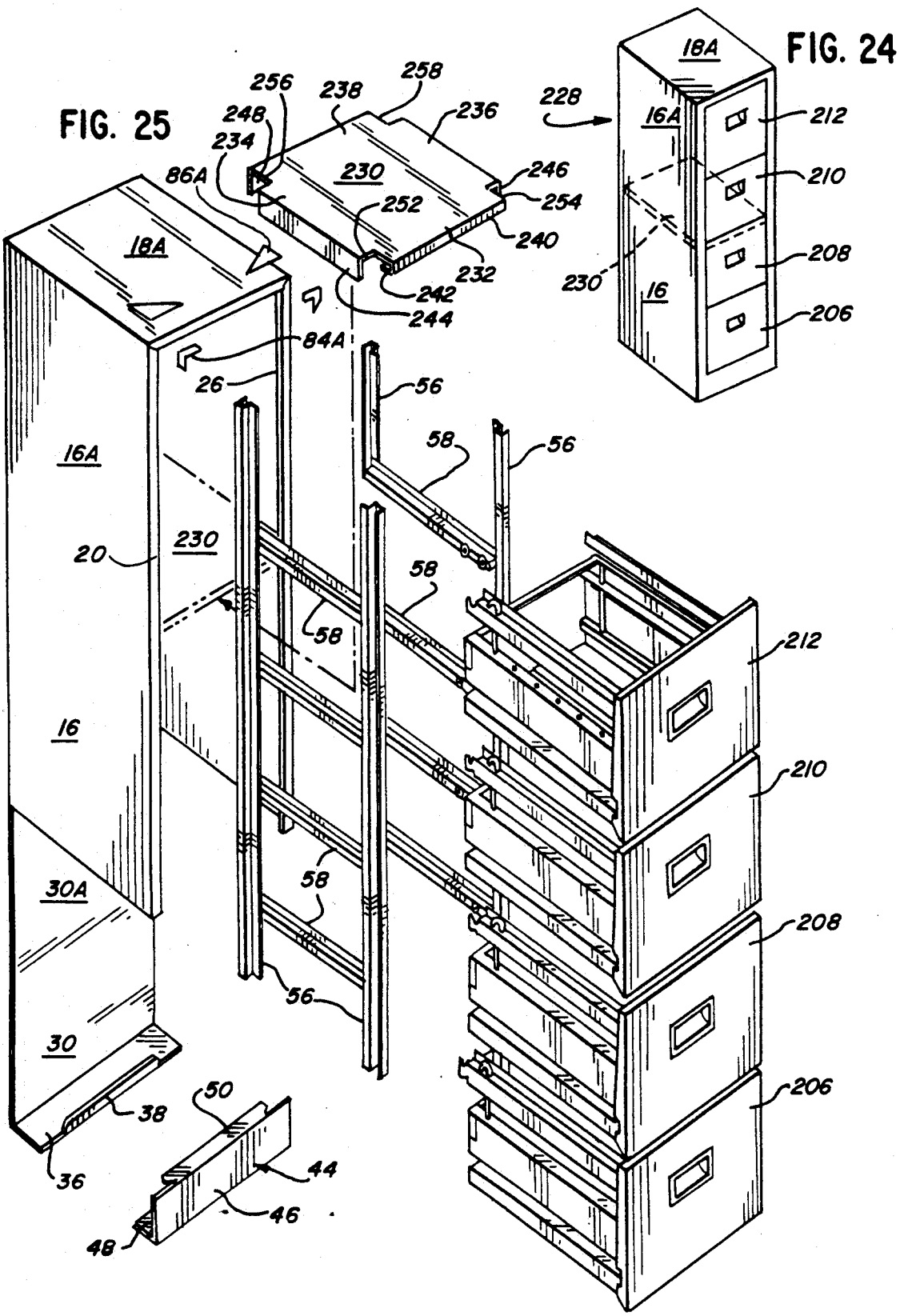
FIG. 24 is a perspective view of a third embodiment of the invention, showing an interior web in phantom lines.
FIG. 25 is an exploded perspective view of the cabinet of FIG. 24.

Yet another embodiment of the invention is the four drawer cabinet 228 shown in FIGS. 24 and 25. This embodiment is essentially the same as that of FIGS. 22 and 23, and is numbered similarly, except in two significant respects. First, its web 230 is a discrete piece. Second, the upper and lower side walls 16A and 16 and the upper and lower back 30A and 30 are each formed in one unitary, continuous piece. Looking at this new embodiment another way, the cabinet 228 is like the cabinet 10C shown in FIG. 1, made twice as tall to accommodate letter file drawers, with the web 230 installed between its second and third drawers.

The web 230 has front, left, right, and back portions, respectively numbered 232, 234, 236, and 238. The front portion 232 is folded twice to provide a front web 240 and a return flange 242. The portions 234, 236, and 238 are folded down to form simple flanges 244, 246, and 248. The latter three flanges are adapted to lay flat against and be adhesively secured to the interior surface of the side walls 16 and the back 30. Notches 252, 254, 256, and 258 are provided to pass the vertical channels 56 in each corner of the cabinet, which run vertically the full height of the cabinet in this embodiment.

The widths of the front portion 232, the front web 240, and the return flange 242 between the notches 252 and 254 correspond to the desired spacing between the return flanges 26. The front portion 232, front web 240, and return flange 242 thereby provide a gauge to maintain the proper spacing between the flanges 26 when the web 230 is installed in the cabinet 228.

The formed web 230 can conveniently be installed in the cabinet 228 after the other elements of the cabinet (except the drawers and the kick plate 44) are installed. For example, it can be inserted into the open cabinet while tipped so its right portion 236 would be higher than its left portion 234 (or vice versa) in the upright cabinet. It is then turned level at its final location. This step is eased by spreading the side walls apart slightly, then turning the web 230 into place. Then the side walls are moved back to their final positions and the kick plate 44 is installed. A suitable jig and clamping can readily be applied as necessary to position and level the web 230 while the adhesive between its flanges 244, 246, and 248 and the corresponding surfaces of the cabinet is setting. For example, a jig can be placed between the web 230 and nearby drawer tracks 58.

The web 230 not only stabilizes the side walls against bowing and strengthens the cabinet 228 but also secures the second drawer 208 against entry from above (even if the third drawer 210 is removed). The web 230 also may have some value in slowing the spread of a fire through the contents of the cabinet 228 by partitioning the cabinet and thus blocking vertical travel of combustion products through the spaces between the drawers and the cabinet walls. Insulation may also be applied to the web 230 and other surfaces of the cabinet 228 to further improve its fire resistance.

In all three disclosed embodiments, the widths of the rolls of metal are correlated to the respective component sizes to avoid unnecessary material waste, to achieve maximum efficiency in manufacture and to realize a final product at low cost. Specifically, the cabinet envelope is cut and formed by bending from one width of metal with the width determined by the depth of the cabinet (FIG. 15). Similarly, the drawer bottom, drawer side walls and roller tracks are cut and formed by bending from a second width of metal with the width determined by the depth of the drawer (FIG. 16). The drawer fronts, drawer back, cabinet back panel and kick plate are cut and formed by bending from a third width of metal with the width determined by the width of the cabinet (FIG. 14). The vertical corner channels and slide tracks, rather than cut and folded, are roll formed from a fourth roll of metal with the width determined by the particular width of these pieces (FIG. 13).

Where mechanical fasteners are needed, the preferable fastening technique is one which deforms and interlocks the overlapping layer of metal, thereby avoiding welding and attendant marring of the prefinished surfaces and also avoiding need for discrete separate fastening elements.

While the preferred embodiment discloses the use of pre-painted metal, the scope of the present invention includes all varieties of finished and unfinished metal. For example, in addition to pre-painted metals, other varieties of prefinished metals include plated metal, anodized metal and vinyl coated metal.

It will thus be seen that improved file cabinets and methods of their construction have been provided which meet the aforestated objects, requirements and desirable characteristics.

It is contemplated by the appended claims to cover any such modification and other embodiments as incorporate those features which constitute the essential features of this invention within the true spirit and scope of the following claims.

What is claimed is:

1. An upright rectangular cabinet for receiving at least two file drawers, said cabinet being of thin gauge sheet metal and having at least four vertical corners, said cabinet comprising:

a. an envelope formed of a top panel, side panels and reinforcing portions, said envelope defining an open front side with at least two drawer recesses for receiving drawers in the interior of said cabinet, said side panels and said reinforcing portions overlapping and coacting to form reinforced structural shapes adjacent each of said vertical corners of the cabinet, said reinforced structural shapes extending substantially the full vertical height of each of said vertical corners, each of said reinforced structural shapes including at least two adjoining sides in generally right angular relationship to one another, each of said two sides of each of said reinforced structural shapes comprising overlapped surface thicknesses of said sheet metal extending over substantially the full vertical height of each of said structural shapes;

b. an adhesive disposed substantially throughout the interface areas between said overlapped thicknesses of said sheet metal defining each of said reinforced structural shapes and bonding said overlapped thicknesses together substantially continuously throughout said interface areas over the vertical extent of said structural shapes to effect a laminated corner structure in each corner of said cabinet;

c. and at least one sheet metal web having a central portion spaced from said top panel and disposed between and segregating two adjacent drawer recesses and having at least a segment thereof substantially spanning the distance between said side panels, and said web having edge portions joined to said side panels.

2. The cabinet of claim 1, wherein the edge portions of said web include integral, perpendicularly folded portions joined to said side panels.

3. The cabinet of claim 2, wherein said web is a separate member and the edge portions of said web are bonded to said side panels by an adhesive.

4. The cabinet of claim 3, wherein said envelope further comprises jamb portions which define the width of said open side, and a peripheral portion of said web is in abutting relation with said jamb portions.

5. The cabinet of claim 2, wherein each said side panel comprises an upper portion above said web and a lower portion below said web.

6. The cabinet of claim 5, wherein the upper and lower portions of each side panel are separate components.

7. The cabinet of claim 6, wherein the integral, folded portions of said web comprises the lower portions of said side panels.

8. The cabinet of claim 5, wherein said upper and lower portions of each side panel form a unitary continuous side panel which extends the full height of said cabinet, and said web is a separate member having its said edge portions adhesively secured to interior surfaces of said side panels;

9. The cabinet of claim 1, wherein said envelope is made from precoated sheet metal.

10. An upright rectangular cabinet of thin gauge sheet metal comprising:

a. an envelope having opposed, spaced, substantially parallel, upright side walls having upper and lower ends and defining a first open side between said side walls and defining a second side opposite said first open side, said envelope including unitary perimeter flanges projecting from said side walls inwardly of said first open side and wall portions projecting from said side walls inwardly of said second side;

b. case wall panel means spanning said first open side and having peripheral portions overlapping interior surface areas of the respective side wall perimeter flanges in face to face relation therewith;

c. adhesive between and bonding said perimeter flanges and said case wall panel means to one another throughout substantially the entire area of such overlapping face to face relationship;

d. structural elements disposed adjacent each of said side walls, said structural elements spanning the distance between said wall portions of said second side and said overlapping peripheral portions of said case wall panel means and coacting with the respective perimeter flanges to compress said adhesive between said perimeter flanges and said overlapping portions of said case wall panel means; and e. at least one generally horizontal web located within said cabinet in a mid area thereof spaced from said upper and lower ends, said web having side edges joined to said side walls;

whereby said structural elements hold said case wall panel means against said flanges during initial bonding by such adhesive and thereafter reinforce said cabinet.

11. A filing cabinet formed of thin gauge sheet metal comprising:

a. an envelope having a pair of spaced, substantially parallel, upright side walls, a back wall, an open front side, defined by spaced vertical edges, for accessing at least two file drawers mounted within the cabinet, and peripheral flanges along at least said vertical edges of said open front side, said flanges extending inwardly of said open front side;

b. a pair of right and left structural assemblies disposed within said cabinet adjacent the respective side walls, each of said structural assemblies including a rear vertical reinforcing element in the respective rear vertical corner of said cabinet, a front vertical reinforcing element in the respective front vertical corner of the cabinet, and at least two drawer track members disposed in vertically spaced relation to one another along each respective side wall and affixed to said respective front and rear vertical reinforcing elements for supporting at least two file drawers;

c. an adhesive between and bonding said rear and front vertical reinforcing elements to the respective back wall and peripheral flange, said bonding extending substantially continuously throughout the vertical height of said reinforcing elements to effect a laminated corner structure; and d. at least one generally horizontal web disposed within said cabinet to be between such two drawers supported by said track members, said web having side edges portions joined to said side walls and a back edge portion joined to said back wall;

e. wherein each of said structural assemblies extends between and abuttingly engages said back wall and and the respective peripheral flanges of said open front side; and f. whereby said reinforcing elements and said back wall are held against said peripheral flanges during initial bonding by said adhesive and thereafter reinforce said cabinet.

12. The cabinet of claim 11, wherein the side edge portions of said web include integral, perpendicularly folded portions joined to said side walls.

13. The cabinet of claim 12 wherein said web is initially a separate component from said envelope and the side edge portions of said web are bonded to said envelope side walls by an adhesive.

14. The cabinet of claim 12, wherein each said side wall comprises an upper portion above said web and a lower portion below said web.

15. The cabinet of claim 14, wherein the upper and lower portions of each said side wall are portions of a unitary continuous side wall which extends the full height of said cabinet, and said web is a separate member having its side edge portions adhesively secured to said side walls.

16. The cabinet of claim 11, wherein said envelope is made from a sheet of precoated sheet metal.

17. The cabinet of claim 11 being adapted to accessibly support at least four vertically aligned drawers, wherein said structural assemblies each includes at least four drawer-supporting track members, and said web is disposed between a pair of adjacent track members.

18. An upright rectangular cabinet of thin gauge sheet metal comprising:

a. an envelope having two spaced, substantially parallel upright side walls having upper and lower ends and defining a first open side between said side walls and defining a second side opposite said first open side, said envelope including unitary perimeter flanges projecting from said side walls inwardly of said first open side, and wall portions projecting from said side walls inwardly of said second side, b. case wall panel means spanning said first open side and having portions overlapping substantially the entire surface areas of the respective perimeter flanges in face to face relation therewith;

c. adhesive between and bonding said perimeter flanges and said case wall panel means to one another throughout substantially the entire area of such overlapping face to face relationship;

d. structural elements disposed adjacent each side wall and having upright portions thereof adjacent each corner of said cabinet and extending substantially the entire vertical height of the respective cabinet corner, said structural elements having transverse segments spanning the distance between said wall portions of said second side and said overlapping portions of said case wall panel means;

e. an adhesive between and bonding said structural elements to adjacent side walls and, respectively, to said case wall panel means and said wall portions throughout substantially the entire vertical height of said side walls; and f. at least one generally horizontal web located within said cabinet in a mid-area thereof spaced from said upper and lower ends, said web having side edges joined to said side walls;

whereby said structural elements further coact with the respective perimeter flanges to compress said adhesive between said perimeter flanges and said overlapping wall portions of said case wall panel means and whereby said structural elements hold said case wall portions against said perimeter flanges during initial bonding by such adhesive and further coact with said side walls, case wall portions and perimeter flanges to form a laminated structure in each vertical corner to reinforce said cabinet.

19. A filing cabinet formed of thin gauge sheet metal and having vertical corners, comprising a. an envelope including at least two spaced substantially parallel side walls and a top wall interconnecting corresponding upper edge portions of said side walls, said envelope forming open front and back sides defined by opposed corner-forming perimeter flanges extending into the open sides from the envelope side walls;

b. at least one back panel having vertically disposed marginal portions in face to face relation with the interior surfaces of the perimeter flanges adjacent said envelope open back side;

c. an adhesive bonding together said perimeter flanges and said back panel marginal portions along substantially their entire vertical height;

d. structural elements adjacent the envelope side walls and extending between the perimeter flanges at said envelope open front side and said back panel marginal portions, said structural elements including a vertical reinforcing member disposed within the cabinet interior and adjacent each vertical corner thereof, said envelope, back panel and vertical reinforcing members forming multi-thickness structural shapes at each of said cabinet corners extending substantially the full vertical height of said cabinet corners;

e. each said reinforcing member having a plurality of vertical sides and at least one side thereof comprising a thickness of the respective multi-thickness structural shape, said at least one side of said reinforcing member being laminated to said envelope substantially continuously throughout the respective vertical corner height and reinforcing the respective cabinet vertical corner;

f. substantially horizontal elements affixed to said vertical reinforcing members and disposed adjacent each envelope side wall for slidably supporting a plurality of vertically aligned drawers within said cabinet; and g. at least one web within said cabinet interior, said web having a central portion disposed parallel to and spaced below said top wall in a position to be between two such drawers, side edges joined to said side walls, and a back edge joined to said back panel.

20. The cabinet of claim 19, wherein said envelope is unitary.

* * * * *